US011761051B2

(12) United States Patent
Khouja et al.

(10) Patent No.: US 11,761,051 B2
(45) Date of Patent: Sep. 19, 2023

(54) HIGH TENSILE AND HIGH TOUGHNESS STEELS

(71) Applicant: VALLOUREC DEUTSCHLAND GmbH, Dusseldorf (DE)

(72) Inventors: Mahrez Khouja, Boulogne Billancourt (FR); Bernhard Koschlig, Boulogne Billancourt (FR); Ralf Hojda, Boulogne Billancourt (FR)

(73) Assignee: VALLOUREC DEUTSCHLAND GmbH, Dusseldorf (DE)

( * ) Notice: Subject to any disclaimer, the term of this patent is extended or adjusted under 35 U.S.C. 154(b) by 0 days.

(21) Appl. No.: 16/968,724

(22) PCT Filed: Feb. 22, 2019

(86) PCT No.: PCT/EP2019/054484
§ 371 (c)(1),
(2) Date: Aug. 10, 2020

(87) PCT Pub. No.: WO2019/162463
PCT Pub. Date: Aug. 29, 2019

(65) Prior Publication Data

US 2021/0032715 A1 Feb. 4, 2021

(30) Foreign Application Priority Data

Feb. 23, 2018 (EP) ..... 18158401

(51) Int. Cl.
*C22C 38/00* (2006.01)
*C21D 9/08* (2006.01)
(Continued)

(52) U.S. Cl.
CPC ..... *C21D 9/085* (2013.01); *C21D 8/105* (2013.01); *C22C 38/02* (2013.01); *C22C 38/04* (2013.01);
(Continued)

(58) Field of Classification Search
None
See application file for complete search history.

(56) References Cited

U.S. PATENT DOCUMENTS

2005/0087269 A1* 4/2005 Merwin ..... C21D 9/08 148/590
2012/0186704 A1* 7/2012 Eguchi ..... C22C 38/06 148/500
(Continued)

FOREIGN PATENT DOCUMENTS

CN 101545077 A 9/2009
CN 101935808 A 1/2011
(Continued)

OTHER PUBLICATIONS

International Search Report dated Mar. 27, 2019 in PCT/EP2019/054484, 5 pages.
(Continued)

*Primary Examiner* — Humera N. Sheikh
*Assistant Examiner* — Kim S. Horger
(74) *Attorney, Agent, or Firm* — Oblon, McClelland, Maier & Neustadt, L.L.P.

(57) ABSTRACT

The present invention deals with alloyed steels having yield strength of at least 862 MPa (125 Ksi) and exhibiting outstanding hardness and toughness behavior, especially under stringent conditions which may be subjected to frost-heave and thaw settlement cycles, namely at subzero temperatures. The invention also relates to a seamless pipe comprising said steel and a method of production of said pipe thereof.

15 Claims, 7 Drawing Sheets

Figure 1:
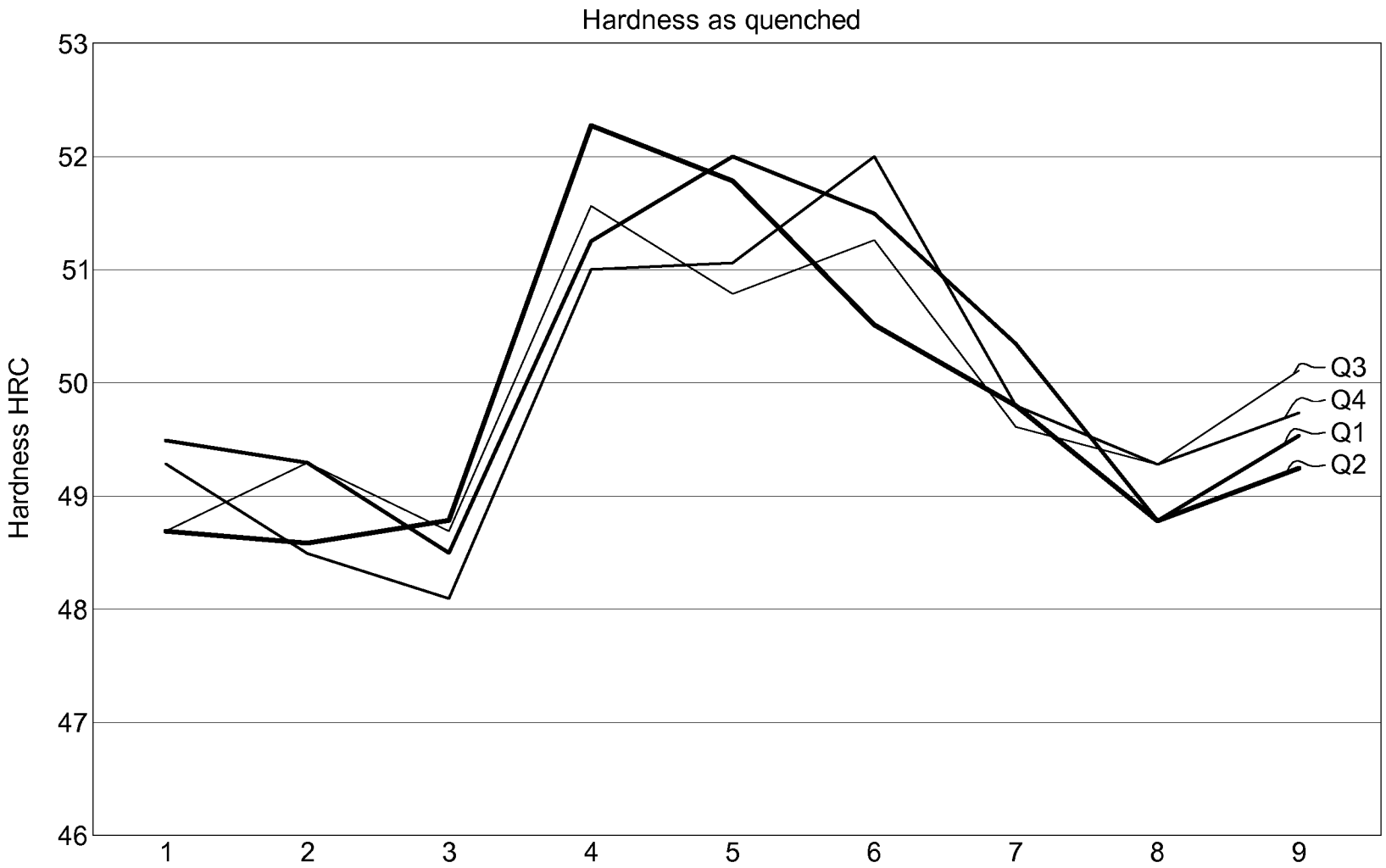

(51) Int. Cl.

| | |
|---|---|
| ***C21D 8/10*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/50*** | (2006.01) |

(52) U.S. Cl.

CPC ..... *C22C 38/06* (2013.01); *C22C 38/44* (2013.01); *C22C 38/50* (2013.01); *C21D 2211/008* (2013.01)

(56) References Cited

U.S. PATENT DOCUMENTS

| | | | |
|---|---|---|---|
| 2014/0352836 | A1 | 12/2014 | Eguchi et al. |
| 2015/0315667 | A1 | 11/2015 | Eguchi et al. |
| 2016/0032432 | A1 | 2/2016 | Li et al. |
| 2017/0219131 | A1 | 8/2017 | Kondo et al. |
| 2017/0349963 | A1 | 12/2017 | Yuga et al. |
| 2017/0349964 | A1 | 12/2017 | Yuga et al. |

FOREIGN PATENT DOCUMENTS

| | | | |
|---|---|---|---|
| CN | 102456677 | A | 5/2012 |
| CN | 106282801 | A | 1/2017 |
| EP | 2 447 386 | A1 | 5/2012 |
| EP | 3 173 501 | A1 | 5/2017 |

OTHER PUBLICATIONS

Salzgitter: "Delivery program for steel pipes", XP055466182, Dec. 1, 2015, 21 pages Retrieved from the Internet: URL:http://www.salzgitter-mannesmann-stahl handel.de/Service/170222 Delivery program for steel pipes.pdf [retrieved on Apr. 11, 2018].

Office Action dated Jan. 6, 2022, in corresponding Chinese Patent Application No. 201980012649 (with English machine translation).

Office Action dated Nov. 29, 2022, in corresponding Chinese Patent Application No. 201980012849.1 (English Translation only), 12 pages.

* cited by examiner

Transition curve transv

Transition curve transv

HIGH TENSILE AND HIGH TOUGHNESS STEELS

The present invention deals with alloyed steels having yield strength of at least 862 MPa (125 Ksi) and exhibiting outstanding hardness and toughness behavior, especially under stringent conditions which may be subjected to frost-heave and thaw settlement cycles, namely at subzero temperatures.

In particular, the steel of the present invention can be used in accessories for oil and gas wells, onshore or offshore applications, and mechanical applications as hydraulic cylinder, especially where harsh environmental conditions and service temperatures down to −60° C. occur.

The steel of the present invention is therefore particularly suitable for subzero arctic applications.

The invention also relates to a seamless pipe comprising said steel and a method of production of said pipe thereof.

The development of oil and gas fields in the Arctic regions had encouraged a search for accessories made of steels having good and stable mechanical properties and a satisfying toughness behavior at low temperatures, especially where high imposed strains can take place at subzero service temperatures up to −60° C. or even up to −80° C.

For such applications, several attempts have been made to develop steels exhibiting good mechanical properties, such as high yield strength ($Y_s$) and ultimate tensile strength ($UT_s$), and good impact toughness down to temperatures as low as −60° C. in order to manufacture various products, such as seamless pipes, which may be conveniently used on drilling site.

The standard API 5CT provides a detailed specification for steel pipes for wall thickness up to 38.1 mm (1.5"). For thicker wall thickness (e.g. up to 76.2 mm (3")), there is no standard requirements.

However, the above mentioned stringent conditions require the manufacture of higher grade steels than those conventionally used, with higher yield and ultimate tensile strengths, which also exhibit excellent ductility or toughness properties at subzero temperatures, such as temperatures as low as −60° C. or −80° C. and suitable for heavy wall thickness.

While for welded pipes or plate production the properties targeted for the steel grades up to 690 MPa grades, or even higher grades, could be achieved by a combination of thermo-mechanical rolling with slightly changed chemical composition and heat treatment, the required properties for seamless pipes must be attained using a controlled rolling process followed by quenching and tempering treatment in combination with a well adjusted chemical analysis.

The quenching treatment allows the formation of a martensitic phase in the microstructure of the seamless pipes in order to improve their strengths.

The required increase in strength while maintaining adequate ductility of hot-processed seamless pipes for the afore-described applications also requires the development of new alloying concepts. In particular, adequate high ductility or toughness at low service temperatures is difficult to attain with conventional alloying concepts or conventional processes, especially for steels having yield strength above 690 MPa.

Typically known methods in increasing the strengths are increasing the carbon content or the carbon equivalent by using conventional alloying concepts and/or using micro alloying concepts, based on the process of precipitation hardening.

Micro-alloying elements, such as titanium, niobium and vanadium, are generally speaking, also employed to increase the strength. Titanium already partially precipitates at high temperatures in the liquid phase as very coarse titanium nitride. Niobium forms niobium (C, N) precipitates at lower temperatures. With further decreasing temperature, vanadium accumulates with carbon and nitrogen in form of carbo-nitrides, and in case of VC-particles it leads to material embrittlement.

Nevertheless exceedingly coarse precipitates of these micro-alloying elements frequently impede the ductility. Accordingly, the concentration of these alloying elements is generally limited. In addition, the concentration of carbon and nitrogen required for the formation of the precipitates must be taken into account, making the whole chemical composition definition complex.

Those well known concepts could therefore lead to the ductility or toughness deterioration of the steels.

In order to overcome these aforementioned drawbacks, new alloying concepts based on the addition of elements suitable to increase strengths by solution hardening in combination with micro-alloying techniques have been duly investigated.

However, the seamless pipes obtained with said steels do not exhibit stable mechanical properties and a satisfying ductility or toughness behavior at very low service temperatures, especially at subzero temperatures, which make them difficult and tedious to be used for arctic applications.

Indeed, the hardness of these seamless pipes significantly decreases with their wall thickness which implies that their microstructure, especially the martensitic transformation occurring during the quenching step, is uneven, especially in mid-wall position. It means that the hardness varies upon the thickness of the seamless pipes which will severely impede their use in offshore applications under stringent conditions.

In addition, according to the Charpy impact tests ASTM E23—Type A on a full size sample (10×10 mm), the toughness values of seamless pipes obtained with aforementioned steels significantly drop at subzero temperatures which also hamper their potential use for arctic applications.

For example, the toughness values of such steels with wall thickness of about 40 to 50 mm decrease by almost 43% between 0° C. and −40° C. according to the Charpy impact tests ASTM E23—Type A on a full size sample (10×10 mm) which means that the toughness behavior of seamless pipes obtained with such steels is not steady at subzero temperatures.

Therefore there is a real need to provide steels suitable for arctic applications which exhibit good and stable mechanical properties and excellent toughness behavior at subzero service temperatures.

Moreover, one of the goals of the present invention is to afford steels allowing the manufacture of seamless pipes, that can be used in offshore applications, line process pipes and mechanical applications, where subzero service temperatures occur.

In particular, one of the purposes of the present invention is to provide steels having high yield and ultimate tensile strengths, excellent impact properties at service temperatures down to −60° C. (in transversal directions) across the entire wall thickness, and which are able to improve the hardness properties of seamless pipes.

More particularly, one of the purposes of the present invention is to provide grade steel products having higher yield strengths than P110 or Q125 grade steel products (respectively corresponding to yield strength of at least 758 and 862 MPa) with good and uniform mechanical properties and a high toughness at low temperatures allowing them to be used in Arctic regions.

Even more specifically, the present invention namely aims at providing steel for seamless pipe having high tensile and high toughness properties at subzero service temperatures.

Hence the present invention relates to a steel for seamless pipe having chemical composition consisting in (the following elements being in weight percent):

C: from 0.27 to 0.30 wt %,
Si: from 0.20 to 0.35 wt %,
Mn: from 0.80 to 0.90 wt %,
Cr: from 1.30 to 1.45 wt %,
Mo: from 0.65 to 0.75 wt %,
Ni: from 0.15 to 0.25 wt %,
Cu: max 0.25 wt %,
Al: from 0.015 to 0.035 wt %,
Ti: from 0.024 to 0.038 wt %,
N: max 0.012 wt %,
V: max 0.05 wt %,
B: from 0.001 to 0.0025 wt %,
Nb: from 0.02 to 0.03 wt %, wherein the balance of said steel being iron and unavoidable impurities from the industrial processing, and having a yield strength (Ys) of at least 862 MPa and an ultimate tensile strength ($UT_S$), wherein a ratio between the yield strength (Ys) and the ultimate tensile strength (UTs) lower than 0.93.

The steel of the present invention exhibits a low yield to ultimate tensile strength ratio combined with yield strength of at least 862 MPa which means that such steel also has an ultimate tensile strength of at least 927 MPa, preferably at least 1000 MPa.

Consequently, such steel leads to seamless pipes, having a high strain capacity. In other words, such steels are able to improve the strain capacity of seamless pipes.

Furthermore, the steel of the present invention displays excellent toughness behavior at subzero service temperatures, for example for a steel grade of 125 ksi, a toughness value in the longitudinal direction of at least 120 Joules at −40° C. and of about 100 Joules at −60° C. and a toughness value in the transverse direction of at least 100 Joules at −40° C. and of about 80 Joules at −60° C. according to the Charpy impact tests ASTM E23—Type A on a full size sample (10×10 mm).

More particularly, the toughness values are steady between 0° C. and −40° C. in the transversal directions according to the Charpy impact tests ASTM E23—Type A on a full size sample (10×10 mm) which means that the toughness behavior is steady at subzero temperatures.

In addition, such steel leads to seamless pipes, exhibiting uniform hardness throughout their thickness.

Indeed, the steel of the present invention presents a substantially uniform microstructure, i.e. wherein the amount of martensite phase is at least 95% related to the entire microstructure, preferably 99%, which ensures the uniformity of the mechanical properties of seamless pipes based on such steels.

It means that the steel of the present invention has higher yield strengths than P110 or Q125 grade steel products, at least 125 Ksi (862 MPa), preferably at least 930 MPa (135 Ksi) with high ultimate tensile strength and high toughness behavior at low temperatures.

It also means that the steel of the present invention is able to improve the hardness and hardenability of seamless pipe.

Therefore, the steel of the present invention is particularly suitable for subzero arctic applications.

As a result, the steel of the present invention is able to lead to seamless pipes having high yield and tensile strengths, a high strain capacity, a high and uniform hardness, namely throughout their entire length and wall thickness, and exhibiting a high and steady toughness performance at subzero temperatures.

In particular, the steel according to the present invention is advantageously used to obtain seamless pipe, preferably having a wall thickness above 12.5 mm, more preferably above 20 mm and even more preferably ranging from 38 mm to 78 mm.

Hence, the steel can be used to obtain seamless pipe with high wall thicknesses whose mechanical properties are stable, whether on the outside, inside, or at mid-wall. That means that the mechanical properties do not depend upon the thickness of the wall which is an asset where high strains are imposed under stringent conditions.

Another object of the present invention deals with a method of production of steel seamless pipe comprising at least the following successive steps:

(i) providing a steel having the chemical composition as previously defined, (ii) hot forming the steel at a temperature ranging from 1100° C. to 1300° C. through a hot forming process to obtain a pipe, then (iii) heating up the pipe to an austenitizing temperature (AT) above or equal to 890° C. and keeping said pipe at the austenitizing temperature (AT) during a time comprised between 5 and 30 minutes, followed by cooling the pipe to a temperature of at most 100° C. in order to obtain a quenched pipe, and heating up and holding said quenched pipe at a tempering temperature (TT) ranging from 580° C. to 720° C. and keeping it at the tempering temperature (TT) during a tempering time, and then cooling it to a temperature of at most 20° C., in order to obtain a quenched and tempered pipe, (iv) measuring the yield strength to ultimate tensile strength ratio and controlling that said ratio is lower than 0.93.

The method according to the present invention enables to lead to steel seamless pipe having a substantially uniform microstructure mainly composed of martensite, preferably the amount of martensite is at least 95% related to the entire microstructure, preferably 99% related to the entire microstructure. The sum of ferrite, bainite and martensite is 100%.

As can be seen from the method of the present invention, the yield strength to ultimate tensile strength ratio is a control parameter which will ensure together with the chemical composition of the steel of the present invention the stability of the mechanical properties, especially the hardness uniformity throughout the wall thickness of the steel seamless pipe, the high tensile strength values and the high toughness at subzero temperatures.

In other words, the yield strength to ultimate tensile strength ratio and the chemical composition will ensure the required performances of the steel.

The invention also concerns a seamless pipe made of the steel previously defined.

As previously mentioned the steel seamless pipe is particularly suitable for arctic applications and may be used for accessory for oil and gas and/or a mechanical component, preferably in offshore applications in Arctic regions.

The steel seamless pipe presents the advantages of having good and stable mechanical properties throughout its length and wall thickness, which is the distinction of a substantially uniform microstructure, and a high toughness at subzero temperatures.

Another subject of the present invention is directed to oil and gas accessory and/or mechanical component comprising at least a seamless pipe as previously mentioned.

Other subjects and characteristics, aspects and advantages of the invention will emerge even more clearly on reading the description and the example that follows.

In the text herein below, and unless otherwise indicated, the limits of a range of values are included in that range, in particular in the expressions "between" and "ranges from . . . to . . . ".

Moreover, the expression "at least one" used in the present description is equivalent to the expression "one or more".

According to the present invention, the yield strength to ultimate tensile strength ratio of the steel is lower than 0.93 which means that the value 0.93 is excluded.

In a preferred embodiment, the steel according to the present invention has a yield strength to ultimate tensile strength ratio lower than 0.9, preferably lower than 0.88.

Preferably, the yield strength to ultimate tensile strength ratio of the steel according to the present invention ranges from 0.84 to 0.93, the value 0.93 not being included.

More preferably, the yield strength to ultimate tensile strength ratio of the steel according to the present invention ranges from 0.84 to 0.91, even more preferably from 0.85 to 0.90.

In a preferred embodiment, the steel according to the present invention has yield strength (Ys) of at least 900 MPa, preferably of at least 930 MPa.

Preferably, the steel yield strength ranges from 862 MPa to 1200 MPa, more preferably from 900 MPa to 1100 MPa, even more preferably from 930 MPa to 1100 MPa.

In a preferred embodiment, the steel according to the present invention has an ultimate tensile strength (UTs) of at least 950 MPa, preferably of at least 1000 MPa, more preferably of at least 1035 MPa.

It means that such steel is suitable to manufactured seamless pipes that are suitable to sustain a high capacity of strain.

According to a preferred embodiment, the steel according to the present invention has a toughness value at −40° C. in the transverse direction, according to the Charpy impact tests ASTM E23—Type A on a full size sample (10×10 mm) of at least:

| Yield strength (kSi) | Charpy test energy (J) |
|---|---|
| 125-135 (included) | 100 |
| 135 (excluded)-155 | 80 |

Especially, the steel according to the present invention has a toughness value at −60° C. in the transverse direction according to the Charpy impact tests ASTM E23—Type A on a full size sample (10×10 mm) of at least:

| Yield strength (kSi) | Charpy test energy (J) |
|---|---|
| 125-135 (included) | 80 |
| 135 (excluded)-155 | 64 |

It means that the steel of the present invention exhibits an improved toughness at subzero temperatures.

It means that said steel clearly adopts a ductile behavior at subzero temperatures.

Preferably, the steel according to the invention has a chemical composition that satisfies the relation below between the nickel, chromium and manganese contents:

$$\Sigma(Ni,Cr,Mn) \geq 2.2$$

This means that the steel of the present invention advantageously satisfies the criteria DI of the ASTM A255 standard. Even more preferably, the steel according to the invention has a chemical composition that satisfies the relation below between the nickel, chromium, manganese and silicium contents:

$$\Sigma(Ni,Cr,Mn,Si) \geq 2.4$$

According to a preferred embodiment, the steel according to the invention has a microstructure comprising at least 95% of martensite based on the entire microstructure, preferably 99% of martensite based on the entire microstructure. The sum of ferrite, bainite and martensite is 100%.

Also, within the framework of the present invention, the influence of chemical composition elements, preferable microstructural features and production process parameters will be further detailed below.

It is reminded that the chemical composition ranges are expressed in weight percent and include upper and lower limits.

Elements of the Steel Chemical Composition

Carbon: 0.27% to 0.30%

Carbon is a strong austenite former that significantly increases the yield strength and the hardness of the steel according to the invention. Below 0.27% the yield strength and the tensile strength decrease significantly and there is a risk to have yield strength below expectations. Above 0.30%, properties such as weldability, ductility and toughness are negatively affected.

Silicon: 0.20% to 0.35%

Silicon is an element which deoxidizes liquid steel. A content of at least 0.20% can produce such an effect. Silicon also increases strength and elongation at levels above 0.20% in the invention. Above 0.35% the toughness of the steel according to the invention is negatively affected, it decreases. To avoid such detrimental effect, the Si content is between 0.20 and 0.35%.

Preferably, the silicon content ranges from 0.22 to 0.30 wt % based on the total weight of the steel chemical composition.

Manganese: 0.80% to 0.90%

Manganese is an element which improves the forgeability and hardness of steel and it contributes to the aptitude of the steel to be quenched. Furthermore, this element is also a strong austenite former which increases the strength of the steel. Consequently, its content should be at a minimum value of 0.80%. Above 0.90%, weldability and toughness may be negatively affected.

Furthermore, above 0.90% an increase of austenitic phase is expected which may lead to an uneven microstructure by decreasing the amount of martensitic phase impeding the stability of the mechanical properties.

Preferably, the manganese content ranges from 0.80 to 0.85 wt %, preferably from 0.80 to 0.83 wt % based on the total weight of the steel chemical composition.

Aluminium: 0.015% to 0.035%

Aluminium is a powerful steel deoxidant and its presence also enhances the desulphurization of steel. It is added in an amount of at least 0.015% in order to have this effect.

However, beyond 0.035%, there is saturation effect with regard to above mentioned effect. In addition, coarse and harmful to ductility Al nitrides tend to be formed. For these reasons, the Al content should be between 0.015 and 0.035%.

Preferably, the aluminium content ranges from 0.017 to 0.030 wt %, preferably from 0.020 to 0.028 wt % based on the total weight of the steel chemical composition.

Copper: max 0.25%

Copper is an element for solution hardening but this element is known to generally be detrimental to toughness and weldability. Copper presence will have the tendency to impede the toughness of the steel. For this reason, the amount of Cu should be limited at most at 0.25.

Preferably, the copper content ranges from 0.1 to 0.25 wt %, preferably from 0.1 to 0.2 wt % based on the total weight of the steel chemical composition.

Chromium: 1.30% to 1.45%

The presence of Chromium in the steel according to the invention creates chromium precipitates that increase especially the yield strength. For this reason, a minimum Cr content of 1.30% is needed in order to increase significantly yield strength. Above 1.45% the precipitation density effects negatively the toughness of the steel according to the invention.

Preferably, the chromium content ranges from 1.30 to 1.40 wt %, preferably from 1.35 to 1.40 wt % based on the total weight of the steel chemical composition.

Nickel: 0.15% to 0.25%

Nickel is a very important element for solution hardening in the steel of the invention. Ni increases yield strength and tensile strength. In combination with the presence of Cu, it improves the toughness properties. For this reason, its minimum content is 0.15%. Above 0.25% the surface quality of the steel according to the invention is negatively impacted by the hot rolling processes.

Preferably, the nickel content ranges from 0.15 to 0.20 wt %, based on the total weight of the steel chemical composition.

Molybdenum: 0.65% to 0.75%

Molybdenum increases both yield and tensile strength and supports the homogeneity of the mechanical properties, the microstructure and the toughness in the base material through the length and thickness of the pipe. Below 0.65% the above described effects are not effective enough. Above 0.75% the steel behavior when it comes to toughness is negatively impacted.

Preferably, the molybdenum content ranges from 0.65 to 0.70 wt % based on the total weight of the steel chemical composition.

Niobium: 0.020% to 0.030%

Niobium presence leads to carbide and/or nitride precipitates leading to a fine grain size microstructure by grain boundary pinning effects and improved tensile strength. For all these effects, a minimum of 0.020% of Nb is needed in the steel of the present invention. Above 0.030%, a strict control of the nitrogen content is needed so as to avoid a brittle effect of NbC. In addition above 0.030%, a decrease of the toughness behavior is expected for the steel according to the invention.

Preferably, the niobium content ranges from 0.020 to 0.025 wt % based on the total weight of the steel chemical composition.

Boron: 0.001% to 0.0025%

Boron presence enhances the hardenability in the seamless pipe.

Below 0.0025% it supports the homogeneity of the mechanical properties, the microstructure and the toughness in the base material through the length and thickness of the pipe. Below 0.001%, the positive effect disappears.

Preferably, the boron content is comprised between 0.001 and 0.0025%, more preferably between 0.001 and 0.0018% by weight based on the total weight of the steel chemical composition.

Vanadium: ≤0.05%

Above 0.05% vanadium precipitates increase the risk of having a scatter in toughness values at low temperatures and/or a shift of transition temperatures to higher temperatures. Consequently, the toughness properties are negatively impacted by vanadium contents above 0.05%. Preferably, the vanadium content is strictly below 0.02% by weight.

Titanium: 0.024% to 0.038%

Ti presence leads to carbide and/or nitride precipitates. TiN are created preferentially to BN. Therefore, B is mainly in atomic form, thus increasing the hardenability performances. Above 0.038%, TiN and TiC reduce the toughness behavior. Below 0.024%, the above described affect is not effective enough.

Preferably, the titanium content ranges from 0.028 to 0.038% by weight based on the total weight of the steel chemical composition.

Nitrogen: ≤0.012%

Above 0.012% big sized nitride precipitations are expected and these precipitates will negatively affect the toughness behavior by changing the transition temperature in the upper range.

Preferably, the nitrogen content ranges from 0.001 to 0.010% by weight based on the total weight of the steel chemical composition.

Residual Elements

The balance is made of Fe and unavoidable impurities resulting from the steel production and casting processes. The contents of main impurity elements are limited as below defined for phosphorus, sulfur and hydrogen:

P≤0.015%, preferably P≤0.012%, more preferably P≤0.010%,

S≤0.003%, preferably S≤0.002%

H≤0.003%

Other elements such as Ca and REM (rare earth minerals) can also be present as unavoidable impurities.

The sum of unavoidable impurity elements contents is lower than 0.1%.

Chemical Composition

According to a preferred embodiment, the chemical composition consists in:

C: from 0.27 to 0.30 wt %,
Si: from 0.20 to 0.35 wt %,
Mn: from 0.80 to 0.90 wt %,
Cr: from 1.30 to 1.45 wt %,
Mo: from 0.65 to 0.75 wt %,
Ni: from 0.15 to 0.25 wt %,
Cu: from 0.10 to 0.25 wt %
Al: from 0.015 to 0.035 wt %,
Ti: from 0.024 to 0.038 wt %,
N: from 0.001 to 0.012 wt %,
V: from 0.001 to 0.050 wt %
B: from 0.001 to 0.0025 wt %,
Nb: from 0.02 to 0.03 wt %, wherein the balance of said steel being iron and unavoidable impurities from the industrial processing.

According to this embodiment, the unavoidable impurities are chosen among:

P≤0.015 wt %, preferably P≤0.012 wt %, more preferably P≤0.010 wt %,

S≤0.003 wt %, preferably S≤0.002 wt % on the total weight of the chemical composition.

In a more preferred embodiment, the chemical composition consists in:

C: from 0.27 to 0.30 wt %,
Si: from 0.22 to 0.30 wt %,
Mn: from 0.80 to 0.85 wt %,
Cr: from 1.30 to 1.40 wt %,
Mo: from 0.65 to 0.70 wt %,
Ni: from 0.15 to 0.20 wt %,
Cu: from 0.10 to 0.20 wt %,
Al: from 0.017 to 0.030 wt %,
Ti: from 0.028 to 0.038 wt %,
N: from 0.001 to 0.010 wt %,
V: from 0.001 to 0.020 wt %
B: from 0.0010 and 0.0018%,
Nb: from 0.020 to 0.025 wt %, wherein the balance of said steel being iron and unavoidable impurities from the industrial processing.

According to this embodiment, the unavoidable impurities are chosen among the elements aforementioned.

Method of Production

As previously mentioned, the method of the present invention comprises at least the following successive steps:

(i) providing a steel having the chemical composition previously disclosed, (ii) a step wherein the steel is hot formed at a temperature ranging from 1100° C. to 1300° C. through a hot forming process to obtain a pipe, then (iii) a step wherein the pipe is heated up to an austenitizing temperature (AT) above or equal to 890° C. and kept at the austenitizing temperature (AT) during a time comprised between 5 and 30 minutes, followed by (iv) a step wherein:

the pipe is cooled to a temperature of at most 100° C. in order to obtain a quenched pipe, and said quenched pipe is then heated up and held at a tempering temperature (TT) ranging from 580° C. to 720° C. and kept at the tempering temperature (TT) during a tempering time, and then cooled to a temperature of at most 20° C., in order to obtain a quenched and tempered pipe, (v) a step wherein a measure of the yield strength to ultimate tensile strength ratio is lower than 0.93.

According to this method, a seamless pipe is produced.

The method of the present invention has the advantage of generating microstructures capable of achieving yield to ultimate tensile strength ratios lower than 0.93.

Indeed, if the steel has a yield strength to ultimate tensile strength ratio over 0.93, then the stability of the mechanical properties and the toughness at low temperatures will be impeded.

Preferably, the method according to the invention comprises the following successive steps listed below.

A steel having the chemical composition previously disclosed is obtained according to casting methods known in the art.

Then the steel is heated at a temperature between 1100° C. and 1300° C., so that at all points the temperature reached is favorable to the high rates of deformation the steel will undergo during hot forming. This temperature range is needed to be in the austenitic range. Preferably the maximum temperature is lower than 1300° C.

The ingot or billet is then hot formed in at least one step with the common worldwide used hot forming processes e.g. forging, pilger process, conti mandrel, premium quality finishing process to a pipe with the desired dimensions.

The minimum deformation ratio shall be at least 2.8.

The pipe is then austenitized i.e. heated up to a temperature (AT) where the microstructure is austenitic. The austenitization temperature (AT) is above Ac3, preferably above 890° C., more preferably at 910° C.

The pipe made of steel according to the invention is then kept at the austenitization temperature (AT) for an austenitization time (At) of at least 5 minutes, the objective being that at all points of the pipe, the temperature reached is at least equal to the austenitization temperature, so as to make sure that the temperature is homogeneous throughout the pipe. The austenitization time (At) shall not be above 30 minutes because above such duration, the austenite grains grow undesirably large and lead to a coarser final structure. This would be detrimental to toughness.

Preferably, the austenitization time (At) ranges from 5 to 15 minutes.

Then, the pipe made of steel according to the invention is cooled to a temperature of at most 100° C., preferably using water quenching. In other words, the pipe is cooled to a temperature of not more than 100° C., preferably to a temperature of 20° C.

Then, the quenched pipe made of steel according to the invention is preferably tempered i.e. heated and held at a tempering temperature (TT) comprised between 580° C. and 720° C., especially between 600° C. and 680° C.

Such tempering is done during a tempering time (Tt) which may be comprised between 10 and 60 minutes, especially during 15 minutes.

Finally, the pipe according to the invention is cooled to a temperature of at most 20° C., preferably 20° C., using air cooling in order to obtain a quenched and tempered pipe.

In this manner, a quenched and tempered pipe made of steel is obtained which contains in area at least 95% of martensite related to the entire microstructure, preferably 99%. The sum of ferrite, bainite and martensite is 100%.

In particular, the method of the present invention preferably comprises at least the following successive steps:

(i) providing a steel having the chemical composition previously disclosed, (ii) a step wherein the steel is hot formed at a temperature ranging from 1100° C. to 1300° C. through a hot forming process to obtain a pipe, then (iii) a step wherein the pipe is heated up to an austenitizing temperature (AT) above or equal to 890° C. and kept at the austenitizing temperature (AT) during a time comprised between 5 and 30 minutes, followed by (iv) a step wherein:

the pipe is cooled to a temperature of 100° C. or less to obtain a quenched pipe and then said quenched pipe is heated up and held at a tempering temperature (TT) ranging from 580° C. to 720° C. and kept at the tempering temperature (TT) during a tempering time, and then cooled to a temperature of at most 20° C., in order to obtain a quenched and tempered pipe, (v) a step wherein a measure of the yield strength to ultimate tensile strength ratio is lower than 0.93.

According to step (v) of the method of the present invention, the measure of the yield strength to ultimate tensile strength ratio is carried out in order to verify that the result is lower than 0.93.

Microstructural Features

Martensite

The martensite content in the steel according to the invention depends on cooling speed during quenching operation, in combination with the chemical composition. The martensite content is at least 95%, preferably 99%. The balance to 100% is ferrite and bainite.

Ferrite

In a preferred embodiment, the quenched and tempered steel pipe according to the invention, after final cooling, presents a microstructure with less than 1% of ferrite in volume fraction. Ideally, there is no ferrite in the steel since it would impact negatively the yield strength (Ys) and the ultimate tensile strength (UTs) according to the invention.

Furthermore, the ferrite presence may also impede the homogeneity of the mechanical properties, especially hardness, through the wall thickness.

Bainite

The bainite content in the steel according to the invention depends on cooling speed during quenching operation, in combination with the chemical composition. Its content is limited to a maximum of 1%. The balance to 100% is ferrite and martensite.

Mechanical Component

As previously mentioned, the invention concerns a seamless pipe comprising the steel previously defined.

Preferably, the seamless pipe is made of said steel.

In a preferred embodiment, the present invention is directed to a steel seamless pipe comprising the steel as previously defined, preferably made of said steel.

According to a preferred embodiment, the steel seamless pipe has a wall thickness above 12.5 mm, preferably above 20 mm and more preferably ranging from 38 mm (lower than 1.5 inch) and 78 mm (higher than 3 inches).

Preferably, the steel seamless pipe has an outer diameter which ranges from 80 mm to 660 mm.

As previously mentioned, the invention also concerns an oil and gas accessory and/or a mechanical component comprising the steel previously defined.

Steel Use

The present invention is also directed to the use of the previously disclosed steel to produce a seamless pipe.

In particular, the invention concerns the use of said steel in order to improve the hardenability of a seamless pipe.

According to the present invention, hardenability of a product is defined as the capacity of the product to hardening when quenched, and is related to the depth and distribution of hardness across a cross section.

According to the present invention, hardenability is measured with the Jominy end quench test.

The present invention is also directed to the use of the previously disclosed steel in the manufacturing of an oil and gas accessory and/or a mechanical component.

Especially, the invention is directed to the use of the previously disclosed steel in the manufacturing of an oil and gas accessory.

The examples below are given as illustrations of the present invention.

EXAMPLES

I. Steel-A (According to the Invention)

The upstream process i.e. from melting to hot forming, is done with commonly-known manufacturing method for seamless steel pipes.

For example, it is desirable that molten steel of the below constituent composition be melted by commonly-used melting practices. The common methods involved are the continuous or ingot casting process.

Table 1 illustrates the chemical composition of a steel according to the present invention (the amounts indicated are calculated in weight percentage, the balance of said composition is made with iron).

TABLE 1

Chemical composition of Steel-A

| Steel | C | Si | Mn | P | S | Cr | Mo | Ni |
|---|---|---|---|---|---|---|---|---|
| A | 0.29 | 0.26 | 0.81 | 0.007 | 0.001 | 1.38 | 0.66 | 0.17 |
| | Cu | Al | Ti | Nb | V | B | N | |
| | 0.14 | 0.025 | 0.033 | 0.024 | 0.007 | 0.0014 | 0.008 | |

Next, these materials are heated at a temperature between 1100° C. and 1300° C., and then manufactured into pipe e.g. by hot working by forging, the plug or pilger mill process, which are commonly-known manufacturing methods, of the above constituent composition into the desired dimensions.

The composition described in Table 1 then undergoes a production process that can be summarized in table 2 below with the step features disclosed below:

- the pipe is heated up to an austenitizing temperature (AT) of 910° C. and kept at this temperature for 10 minutes (At: austenitization time), then
- the pipe is cooled with water to a temperature of 100° C. or lower to obtain a quenched pipe and then said quenched pipe is heated up and held at a tempering temperature (TT) for 15 minutes, and then cooled to a temperature of 20° C. or lower in order to obtain a quenched and tempered pipe,
- the yield strength (Ys) to ultimate tensile strength (UTs) ratio is controlled after the tempering step.

The above mentioned method has been carried out to obtain two seamless pipes (A-1.1 and A-1.2) each having a wall thickness of 38.1 mm (corresponding to 1.5 inch) and two seamless pipes (A-2.1 and A-2.2) each having a wall thickness of 76.2 mm (corresponding to 3 inches).

The parameters of the above method are summarized in Table 2 below:

TABLE 2 process conditions of examples after hot rolling

| Steel | Pipe no | AT (° C.) | At (min) | TT (° C.) | Tt (min) | Wall thickness (mm) |
|---|---|---|---|---|---|---|
| A | A-1.1 | 910 | 10' | 650 | 15 | 38.1 |
| | A-1.2 | 910 | 10' | 650 | 15 | 38.1 |
| | A-2.1 | 910 | 10' | 620 | 15 | 76.2 |
| | A-2.2 | 910 | 10' | 620 | 15 | 76.2 |

The process parameters disclosed in Table 2 are consistent with the present invention.

This led to quenched and tempered steel pipes that, after final cooling from the tempering temperature, present a microstructure comprising at least 99% of martensite based on the microstructure.

Furthermore, the quenched and tempered steel pipes obtained have an outer diameter of 304.8 mm.

1. Mechanical Properties 1.1. Hardness on the Quenched Seamless Pipe

Hardness based on the Rockwell scale (HRC) is measured on the four quadrants (Q1, Q2, Q3 and Q4) of the quenched and tempered steel seamless pipe (specimen A-1.1; wall thickness corresponding to 38.1 mm) obtained from the composition disclosed in Table 1 (steel composition A). Each quadrant represents an angular orientation of 90°.

For each quadrant, hardness has been measured three times on the external, inside and mid-wall of the steel seamless pipe.

The results are summarized in Table 3:

TABLE 3

Hardness (Rockwell scale HRC)

| Quadrant | External | | | Mid-wall | | | Internal | | |
|---|---|---|---|---|---|---|---|---|---|
| Q1 | 49.5 | 49.3 | 48.5 | 51.3 | 52.0 | 51.5 | 50.3 | 48.8 | 49.6 |
| Q2 | 48.7 | 48.6 | 48.8 | 52.3 | 51.8 | 50.5 | 49.8 | 48.8 | 49.3 |
| Q3 | 48.7 | 49.3 | 48.7 | 51.6 | 50.8 | 51.3 | 49.6 | 49.3 | 50.2 |
| Q4 | 49.3 | 48.5 | 48.1 | 51.0 | 51.1 | 52.0 | 49.8 | 49.3 | 49.8 |

FIG. 1 illustrates the hardness values summarized in Table 3 for each quadrant as a function of the location where the hardness measurement has been determined on the pipe wall, i.e. external, internal and mid-wall.

These results show that hardness is homogeneous throughout the seamless pipe.

1.2. Determination of Yield (Ys) and Tensile Strengths (UTs)

1.2.1. Wall Thickness: 38.1 mm (1.5 Inch)

A set of two specimens has been taken, one at each end of the seamless pipe, from the seamless pipe A-1.1 (wall thickness: 38.1 mm) and the seamless pipe A-1.2 (wall thickness: 38.1 mm).

On each specimen, yield strength (Ys in MPa), ultimate tensile strength (UTs in MPa), elongation at break (A %) and the reduction area (min %) have been assessed on two quadrants: 0° and 180° in the longitudinal direction.

The results on the mechanical properties are summarized in Table 4:

TABLE 4

Mechanical properties (Ys, UTs, A(%) and reduction area)

| Specimen | | Ys (MPa) | UTs (MPa) | Ratio Ys/UTs | A % | Reduction area min % |
|---|---|---|---|---|---|---|
| A-1.1.a | Q(0°) | 911 | 1021 | 0.89 | 19.6 | 63.0 |
| | Q(180°) | 907 | 1016 | 0.89 | 20.4 | 64.2 |
| A-1.1.b | Q(0°) | 899 | 1002 | 0.90 | 21.7 | 64.1 |
| | Q(180°) | 908 | 1018 | 0.89 | 20.2 | 63.8 |
| A-1.2.a | Q(0°) | 912 | 1019 | 0.89 | 20.8 | 63.1 |
| | Q(180°) | 908 | 1023 | 0.89 | 19.2 | 63.4 |
| A-1.2.b | Q(0°) | 918 | 1026 | 0.89 | 19.4 | 63.3 |
| | Q(180°) | 900 | 1009 | 0.89 | 20.7 | 63.7 |

The entire specimens exhibit a ratio between yield strength and ultimate tensile strength lower than 0.93.

From these results, one can see that each specimen has high yield and tensile strengths, a high elongation at break and a reduction area of at least 60% before breaking.

Therefore, it means that the specimens made of the steel of the present invention can withstand a high strain deformation.

1.2.2. Wall Thickness: 76.2 mm (3 Inches)

A set of two specimens has been taken, one at each end of the seamless pipe, from the seamless pipe A-2.1 (wall thickness: 76.2 mm) and the seamless pipe A-2.2 (wall thickness: 76.2 mm).

On each specimen, yield strength (Ys in MPa), ultimate tensile strength (UTs in MPa), elongation at break (A %) and the reduction area (min %) have been assessed on two quadrants: 0° and 180° in the longitudinal direction.

The results on the mechanical properties are summarized in Table 5:

TABLE 5

Mechanical properties (Ys, UTs, A(%) and reduction area)

| Specimen | | Ys (MPa) | UTs (MPa) | Ratio Ys/UTs | A % | Reduction area min % |
|---|---|---|---|---|---|---|
| A-2.1.a | Q(0°) | 937 | 1031 | 0.91 | 16.8 | 58.4 |
| | Q(180°) | 922 | 1018 | 0.91 | 19.4 | 60.4 |
| A-2.1.b | Q(0°) | 917 | 1021 | 0.90 | 19.7 | 57.4 |
| | Q(180°) | 930 | 1022 | 0.91 | 20.0 | 56.4 |
| A-2.2.a | Q(0°) | 893 | 1002 | 0.89 | 19.1 | 56.8 |
| | Q(180°) | 898 | 996 | 0.90 | 21.4 | 61.5 |
| A-2.2.b | Q(0°) | 909 | 1007 | 0.90 | 19.7 | 62.4 |
| | Q(180°) | 919 | 1017 | 0.90 | 18.2 | 59.1 |

The entire specimens exhibit a ratio between yield strength and ultimate tensile strength lower than 0.93.

From these results, one can see that each specimen has high yield and tensile strengths, a high elongation at break and a reduction area of about 60% before breaking.

Therefore, it means that the specimens made of the steel of the present invention can sustain a high strain deformation.

2. Impact Energy Results (Wall Thickness: 38.1 mm)

The toughness at low temperatures has been assessed for each previous specimen having a wall thickness of 38.1 mm.

2.2. Transverse Direction

For each specimen, impact energy values in Joules (Kcv) have been determined in the transverse direction according to the Charpy impact tests ASTM E23—Type A on a full size sample (10×10 mm) at −20° C.

For each specimen, those parameters have been determined three times. The average (Ave) is determined for the impact energy values. The results are summarized in Table 6:

TABLE 6

Toughness at low temperatures (transverse)

| Specimens | Orientation | Temp (° C.) | Kcv1 (J) | Kcv2 (J) | Kcv3 (J) | Ave |
|---|---|---|---|---|---|---|
| A-1.1.a | transv | −20° C. | 134 | 131 | 133 | 134 |
| A-1.1.b | | | 139 | 136 | 129 | 135 |
| A-1.2.a | | | 136 | 136 | 135 | 136 |
| A-1.2.b | | | 139 | 139 | 139 | 139 |

2.3. Charpy Transition Values as a Function of Temperatures

A specimen has been taken from the seamless pipe A-1.1 (wall thickness: 38.1 mm) in order to be standardized in dimension and shape for the Charpy tests.

The impact energy values in Joules (Kcv) as a function of temperatures ranging from 0° C. to −60° C. have also been assessed for this specimen in the transversal direction. This parameter has been determined three times at each temperature. The results are summarized in Table 7:

TABLE 7

| Charpy transition values | | | | | | |
|---|---|---|---|---|---|---|
| Specimen | Orientation | Temp (° C.) | Kcv1 (J) | Kcv2 (J) | Kcv3 (J) | Ave (J) |
| A-1.2.c | Transv | 0 | 148 | 143 | 146 | 146 |
| | | −20 | 135 | 142 | 146 | 141 |
| | | −40 | 121 | 112 | 128 | 120 |
| | | −60 | 88 | 94 | 91 | 91 |

Figure 2:
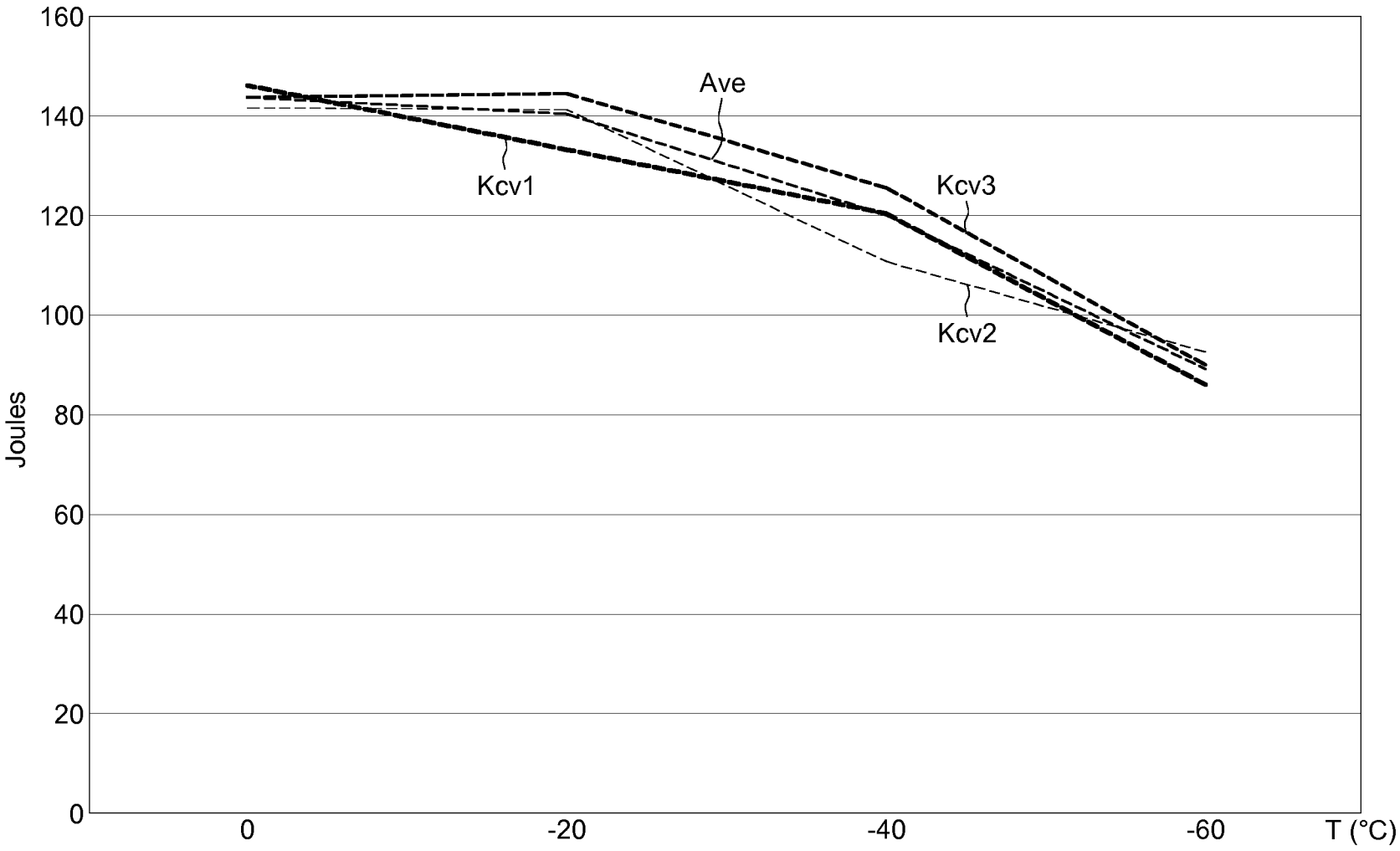

FIG. 2 illustrates the Charpy transition curves (Joules) as a function of temperatures in the transversal direction based on the values disclosed in Table 7 and representative of a steel seamless pipe according to the present invention with a wall thickness of 38.1 mm (1.5 inch).

The results disclosed in Tables 7 clearly show that the steel has a ductile behavior at subzero temperatures. Especially, the specimen exhibits high impact energy values above 90 Joules at −60° C. and a steady behavior.

3. Impact Energy Results (Wall Thickness: 76.2 mm)

The toughness at low temperatures has been assessed for the specimens A-2.1.a, A-2.1.b and A-2.2.a previously disclosed. For the purposes of this assessment, an additional specimen has also been taken out from the seamless pipe A-2 (specimen A-2.2.c).

The measurements have been carried out in transverse directions.

For each previous specimen, impact energy values in Joules (Kcv) have been determined in the transverse direction according to the Charpy impact tests ASTM E23—Type A on a full size sample (10×10 mm) performed at −20° C.

For each specimen, this parameter has been determined three times. The average (Ave) is determined for the impact energy values. The results are summarized in Table 8:

TABLE 8

| Toughness at low temperatures (transverse) | | | | | | |
|---|---|---|---|---|---|---|
| Specimens | Orientation | Temp (° C.) | Kcv1 (J) | Kcv2 (J) | Kcv3 (J) | Ave |
| A-2.1.a | transv | −20° C. | 106 | 104 | 103 | 104 |
| A-2.1.b | | | 121 | 125 | 124 | 123 |
| A-2.2.a | | | 119 | 105 | 121 | 115 |
| A-2.2.c | | | 117 | 124 | 125 | 122 |

From these results, one can see that high values of the impact energy at −20° C. (higher than 100 Joules) are obtained which means that each specimen has a tough behavior at subzero temperatures.

3.3. Charpy Transition Values as a Function of Temperatures

The impact energy values in Joules (Kcv) as a function of temperatures ranging from 0° C. to −60° C. have also been assessed for the specimen A-2.2.c in the transversal direction. This parameter has been determined three times at each temperature. The results are summarized in Table 9:

TABLE 9

| Charpy transition values | | | | | | |
|---|---|---|---|---|---|---|
| Specimen | Orientation | Temp (° C.) | Kcv1 (J) | Kcv2 (J) | Kcv3 (J) | Ave (J) |
| A-2.2.c | Transv | 0 | 127 | 133 | 138 | 133 |
| | | −20 | 117 | 124 | 125 | 122 |

TABLE 9-continued

| Charpy transition values | | | | | | |
|---|---|---|---|---|---|---|
| Specimen | Orientation | Temp (° C.) | Kcv1 (J) | Kcv2 (J) | Kcv3 (J) | Ave (J) |
| | | −40 | 107 | 106 | 111 | 108 |
| | | −60 | 75 | 91 | 83 | 83 |

Figure 3:
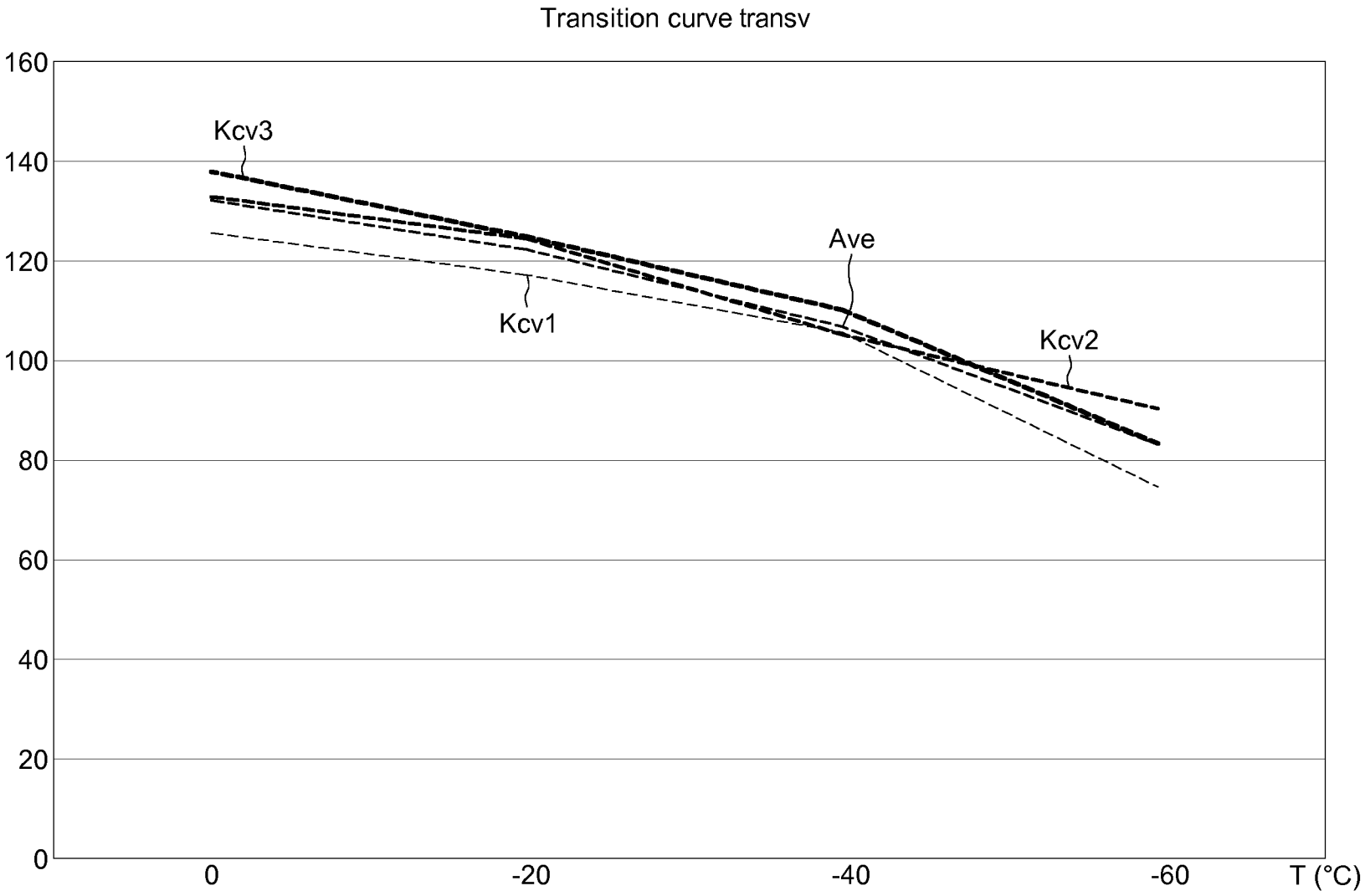

FIG. 3 illustrates the Charpy transition curves (Joules) as a function of temperatures in the transversal direction based on the values disclosed in Table 9 and representative of a steel seamless pipe according to the present invention with a wall thickness of 76.2 mm (3 inches).

From these results, one can see that high values of the impact energy at −60° C. (at least about 80 Joules in average) are obtained which means that each specimen has a tough behavior at subzero temperatures.

Furthermore, the steel of the present invention displays excellent toughness behavior at subzero service temperatures, for example a toughness value in the longitudinal direction of at least 130 Joules at −40° C. and of at least about 100 Joules at −60° C. and a toughness value in the traverse direction of at least 100 Joules at −40° C. and of about 80 Joules at −60° C. according to the Charpy impact tests ASTM E23—Type A on a full size sample (10×10 mm) for a grade 150 ksi steel.

As a consequence, specimens according to the present invention have a toughness and ductile behavior at subzero temperatures whether the wall thickness corresponds to 38.1 mm or 76.2 mm.

5. Impact Energy Results (Wall Thickness: 50.8 mm)

The previously mentioned method has been carried out to obtain a seamless pipe (A-3) having a wall thickness of 50.8 mm (corresponding to 2 inches) from the chemical composition disclosed in Table 1 (steel-A according to the present invention).

The parameters of the above method are summarized in Table 10 below:

TABLE 10

| Process parameters of the method | | | | | | |
|---|---|---|---|---|---|---|
| Steel | Pipe no | At (° C.) | At (min) | TT (° C.) | Tt (min) | Wall thickness (mm) |
| A | A-3 | 910 | 10' | 650 | 15 | 50.8 |

The impact energy values in Joules (Kcv) as a function of temperatures ranging from 0° C. to −60° C. has been assessed for this specimen.

Figure 4:
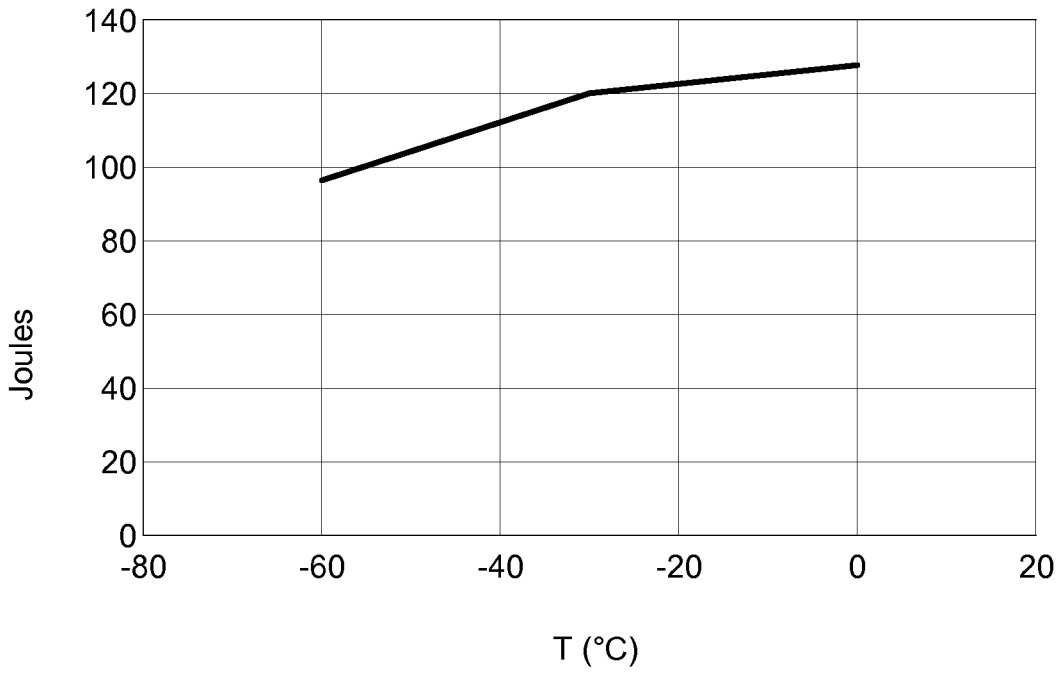

FIG. 4 illustrates the Charpy transition curves (Joules) in the transverse direction for this specimen.

From these results, one can see that high impact energy values at −60° C. (at least about 90 Joules) are obtained which illustrates the toughness behavior of the tested specimen at subzero temperatures.

II. Steel-B (Comparative Steel)

Table 11 illustrates the chemical composition of a comparative steel (the amounts indicated are calculated in weight percentage, the balance of said composition is made with iron).

TABLE 11

| Chemical composition of Steel-B | | | | | | | | |
|---|---|---|---|---|---|---|---|---|
| Steel | C | Si | Mn | P | S | Cr | Mo | Ni |
| B | 0.29 | 0.19 | 0.33 | 0.011 | 0.0014 | 0.95 | 0.8 | 0.04 |
| | Cu | Al | Ti | Nb | V | B | N | |
| | 0.02 | 0.046 | 0.017 | — | 0.003 | 0.0012 | 0.0046 | |

The upstream process and the production process implemented for Steel-B are identical to those described for Steel-A.

The implemented method has been carried out to obtain a seamless pipe (B-1) having a wall thickness of 76.2 mm (corresponding to 3 inches).

The parameters of the above method are summarized in Table 12 below:

TABLE 12

| process conditions of examples after hot rolling | | | | | | |
|---|---|---|---|---|---|---|
| Steel | Pipe no | At (° C.) | At (min) | TT (° C.) | Tt (min) | Wall thickness (mm) |
| B | B-1 | 910 | 10' | 650 | 15 | 76.2 |

1. Mechanical Properties 1.1. Yield and Ultimate Tensile Strengths

A set of three specimens has been taken from the seamless pipe B-1.

On each specimen, yield strength (Ys in MPa), ultimate tensile strength (UTs in MPa) and elongation at break (A %) have been assessed in the longitudinal direction.

In particular, the assessment of these properties has been made on the external wall of the specimens B-1.2 and B-1.3 and the internal wall of the specimen B-1.5.

The results on the mechanical properties are summarized in Table 13:

TABLE 13

| Mechanical properties (Ys, UTs and A (%)) | | | |
|---|---|---|---|
| Specimen | Ys (MPa) | UTs (MPa) | A (%) |
| B-1.2 | 970 | 1046 | 18.7 |
| B-1.3 | 987 | 1062 | 17.8 |
| B-1.5 | 972 | 1049 | 16.3 |

2. Impact Energy Results

A set of three specimens has been taken from the seamless pipe B-1 according to Charpy impact test ASTM E23—Type A on a full size sample (10×10 mm).

The toughness for each specimen has been assessed by determining the impact energy values in the transverse direction at 0° C. For each specimen, impact energy values have been determined three times. The results are given below:

TABLE 14

| Impact energy values at 0° C. | | | | |
|---|---|---|---|---|
| | Orientation | Kcv1 (J) | Kcv2 (J) | Kcv3 (J) |
| B-1.6 | transv | 138 | 132 | 134 |
| B-1.7 | | 134 | 135 | 138 |

For specimen B-1.8, measurements have been determined on the external, internal and mid-wall of the specimen.

TABLE 15

| Impact energy values at 0° C. | | | |
|---|---|---|---|
| B-1.8 | Kcv1 (J) | Kcv2 (J) | Kcv3 (J) |
| external-wall | 131 | 130 | 138 |
| mid-wall | 121 | 126 | 112 |
| internal-wall | 137 | 146 | 152 |

3. Charpy Transition Values as a Function of Temperatures

The impact energy values in Joules (Kcv) as a function of temperatures ranging from 20° C. to −40° C. have been assessed for the specimen B-1.6 in the transverse direction. This parameter has been determined three times at each temperature. The results are summarized in Table 16:

TABLE 16

| Charpy transition values | | | | | | |
|---|---|---|---|---|---|---|
| Specimen | Orientation | Temp (° C.) | Kcv1 (J) | Kcv2 (J) | Kcv3 (J) | Ave (J) |
| B-1.6 | transv | 20 | 114 | 123 | 119 | 119 |
| | | 0 | 138 | 132 | 134 | 135 |
| | | −20 | 110 | 107 | 91 | 103 |
| | | −40 | 79 | 64 | 82 | 75 |

Figure 5:
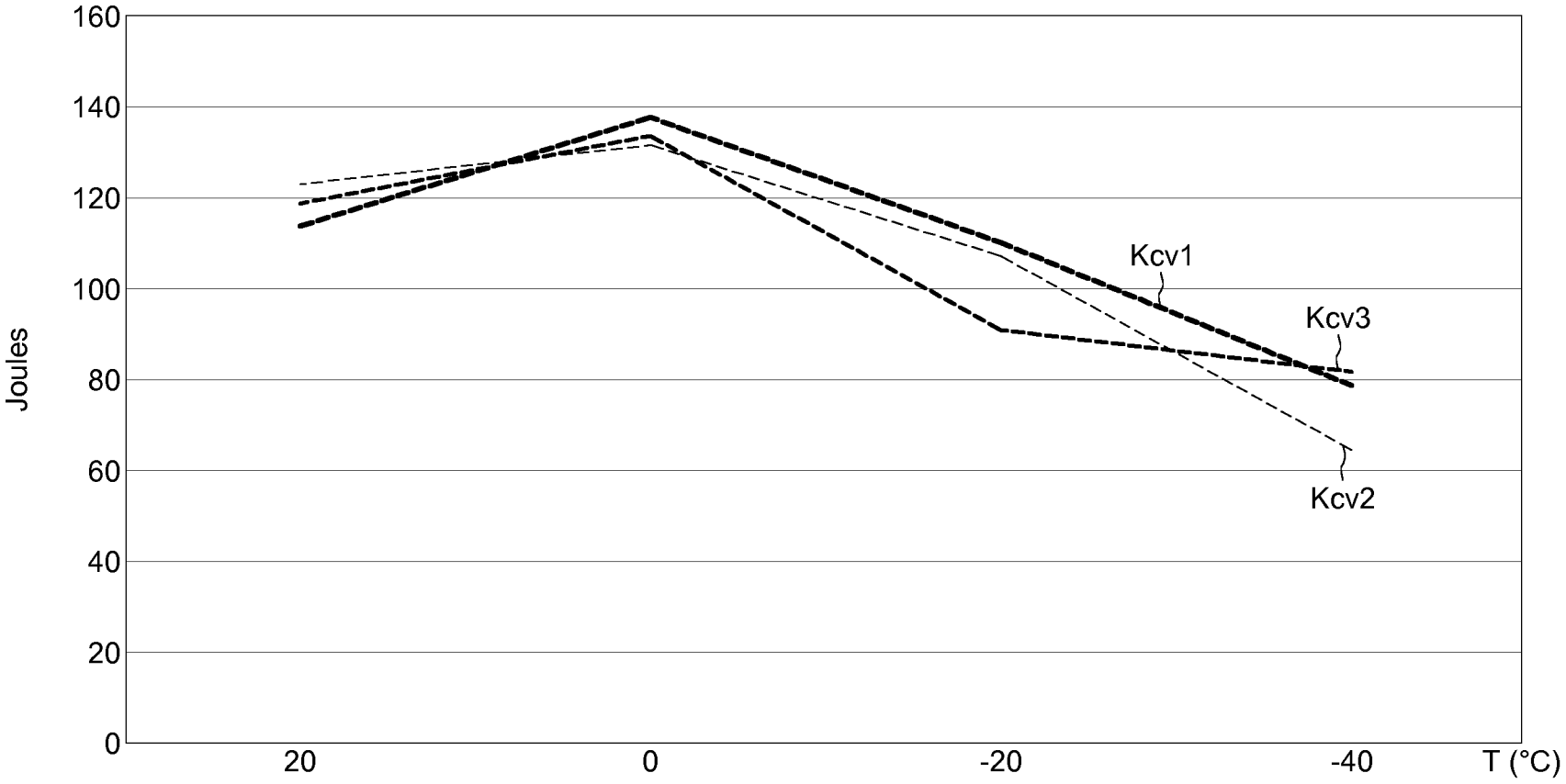

FIG. 5 illustrates the Charpy transition curves (Joules) in the transverse direction for this specimen.

According to these results, one can see that the impact energy values are higher than 110 Joules at 20° C. but then significantly drop at subzero temperatures, especially at −40° C. Indeed, the impact energy is about 75 Joules at −40° C.

Therefore the toughness of the tested specimen significantly decreases at very low temperatures.

IV. Steel D According to the Invention

Table 17 illustrates the chemical composition of a steel according to the present invention (the amounts indicated are calculated in weight percentage, the balance of said composition is made with iron).

TABLE 17

| Chemical composition of Steel-D | | | | | | | | |
|---|---|---|---|---|---|---|---|---|
| Steel | C | Si | Mn | P | S | Cr | Mo | Ni |
| D | 0.28 | 0.32 | 0.87 | 0.011 | 0.001 | 1.45 | 0.71 | 0.18 |
| | Cu | Al | Ti | Nb | V | B | N | |
| | 0.15 | 0.022 | 0.038 | 0.02 | 0.024 | 0.0017 | 0.005 | |

The upstream process and the production process implemented for Steel-D are identical to those described for Steel-A.

In particular, the implemented method has been carried out to obtain a seamless pipe (D-1) having a wall thickness of 38.1 mm (corresponding to 1.5 inch).

The parameters of the above method are summarized in Table 18 below:

TABLE 18

| process conditions of examples after hot rolling | | | | | | |
|---|---|---|---|---|---|---|
| Steel | Pipe no | At (° C.) | At (min) | TT (° C.) | Tt (min) | Wall thickness (mm) |
| D | D-1 | 910 | 10' | 650 | 15 | 38.1 |

The method led to a quenched and tempered steel pipe that, after final cooling from the tempering temperature, presents a microstructure comprising 99% of martensite, balance is ferrite and bainite.

Furthermore, the quenched and tempered steel pipe obtained has an outer diameter of 374.65 mm.

1. Determination of Yield (Ys) and Tensile Strengths (UTs)

A specimen has been taken from the seamless pipe D-1. Yield strength (Ys in MPa), ultimate tensile strength (UTs in MPa) and elongation at break (A in %) have been assessed in the longitudinal direction.

The results on the mechanical properties are summarized in Table 19:

TABLE 19

| Mechanical properties (Ys, UTs and A (%)) | | | | |
|---|---|---|---|---|
| Specimen | Ys (MPa) | UTs (MPa) | Ratio Ys/UTs | A (%) |
| D-1.1 | 996 | 1134 | 0.88 | 17.6 |

2. Hardenability According to Jominy Tests

Hardenability (based on the Rockwell scale) of a specimen obtained from the composition disclosed in Table 17 has been studied according to the Jominy tests.

2.1. Procedure

The shape and dimension of the specimen have been standardized according to the requirements of the Jominy test (ASTM A255).

The Jominy testing was performed after austenization at an austenitizing temperature (AT) of 910° C. and kept at this temperature for 10 minutes (At: austenitization time).

These tests were performed by quenching one end of the specimen with a water quench, measuring the hardness of the specimen at 1.5 mm (approximately one-sixteenth inch) increments from the quenched end and then preparing a plot of the hardness measurements versus distance from the quenched end.

A rapid drop-off in hardness with increasing distance from the quenched end is indicative of low hardenability (hardness). Hence the closer the Jominy curve is to a horizontal line, the greater is the hardenability (hardness).

Generally, the distance from the water quenched end at which the hardness becomes less than Rockwell 50 HRC is referred to herein as the Jominy depth.

2.2. Results

Figure 6:
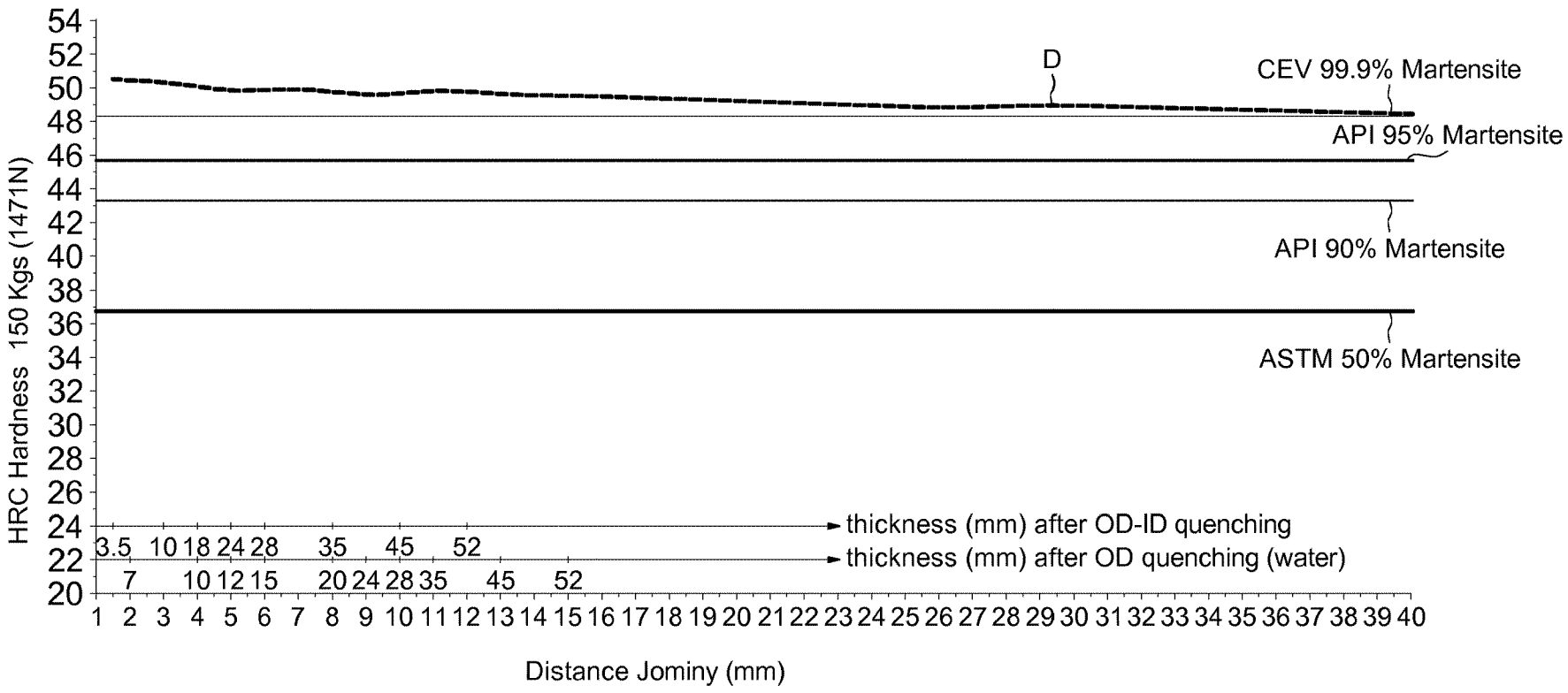

FIG. 6 illustrates the Jominy curve (hardness based on the Rockwell scale) wherein hardness measurements versus distance from the water quenched end are plotted.

The results on this figure show that the Jominy curve remains flat, approximately around 50 HRC, up to a distance of 40 mm from the quenched end of the specimen.

These results demonstrate that hardness remain stable throughout the length of the tested specimen shows a high hardenability.

It is estimated that such quenchability could enable to obtain an entirely martensitic structure (99.9%) for a pipe of 40 mm wall thickness quenched with water.

In other words, the production of a purely martensitic structure for the specimen made with the steel of the present invention was further corroborated by its hardenability Jominy curve.

3. Hardenability Comparison with Comparative Steels 3.1. Steel Composition

Table 20 illustrates the chemical composition of a comparative steel (the amounts indicated are calculated in weight percentage, the balance of said composition is made with iron).

TABLE 20

| Chemical composition of Steel-F | | | | | | | | |
|---|---|---|---|---|---|---|---|---|
| Steel | C | Si | Mn | P | S | Cr | Mo | Ni |
| F | 0.29 | 0.19 | 0.33 | 0.011 | 0.0014 | 0.95 | 0.8 | 0.04 |
| | Cu | Al | Ti | Nb | V | B | N | |
| | 0.02 | 0.046 | 0.017 | — | 0.003 | 0.0012 | 0.0046 | |

3.2. Procedure

Specimen issued from steel compositions F has been standardized according to the requirements of the Jominy test.

The Jominy testing was performed after austenization at an austenitizing temperature (AT) of 910° C. and kept at this temperature for 10 minutes (At: austenitization time).

3.3. Results

Figure 7:
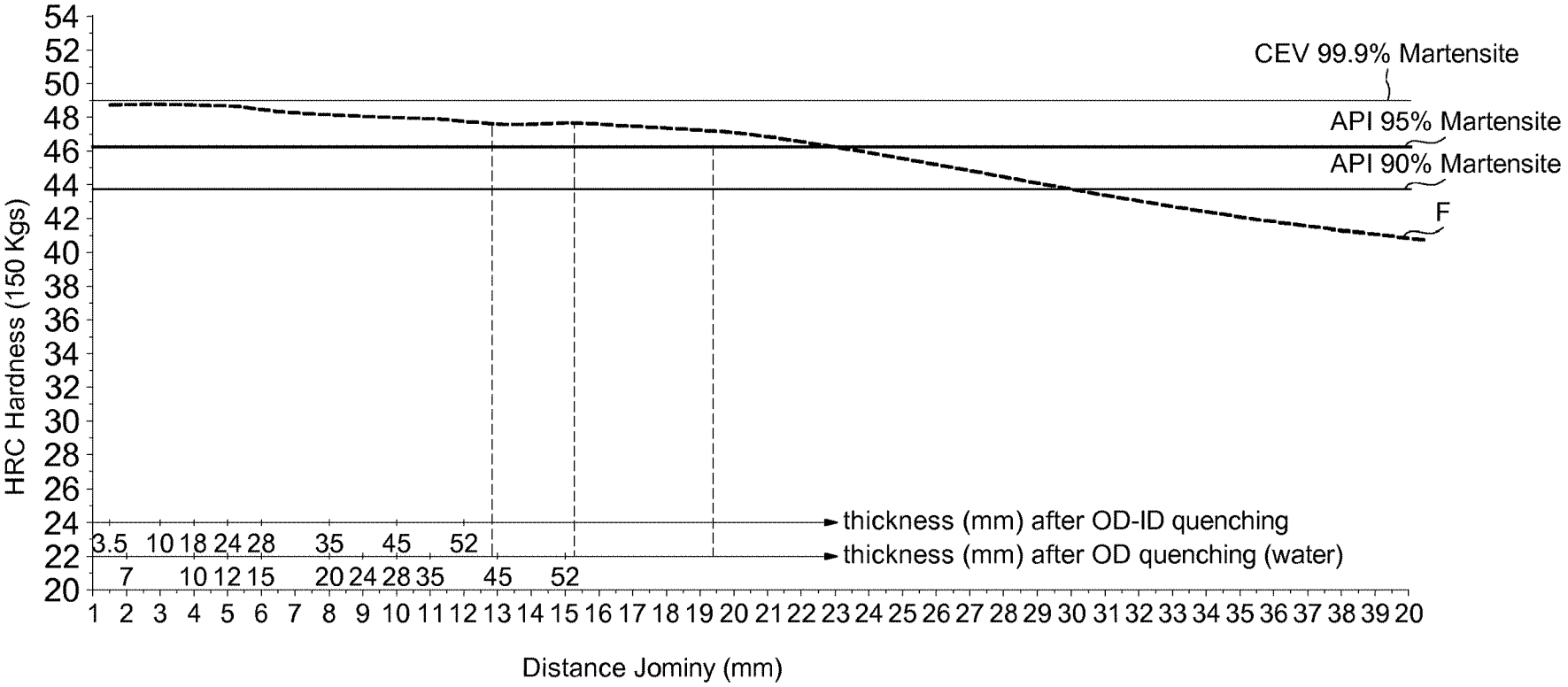

FIG. 7 illustrates the Jominy curves (hardness based on the Rockwell scale) of specimen from steel composition F wherein hardness measurements versus distance from the water quenched end are plotted.

The results on this figure show that the Jominy curve of this specimen is not flat and significantly drops-off with increasing distance from the quenched end.

In particular, the curve of the specimen obtained from steel composition F has an inflexion point around 15 mm before significantly dipping.

These results clearly show that hardness is not stable throughout the length of the tested specimens.

These results also corroborate the fact that the performed quenchability is not capable of leading to an entirely martensitic structure. Indeed, the structure of this specimen is composed of less than 90% of martensite at a distance of 40 mm from the quenched end.

In particular, it means that such quenchability will not enable to obtain an entirely martensitic structure (99.9%) for a pipe of 40 mm wall thickness quenched with water (whether measured with external quench or external and internal quench) but rather a structure having less than 90% of martensite.

The invention claimed is:

1. A seamless steel pipe having the following chemical composition consisting of in weight percent:

C: from 0.27 to 0.30 wt %,

Si: from 0.20 to 0.35 wt %,

Mn: from 0.80 to 0.90 wt %,
Cr: from 1.30 to 1.45 wt %,
Mo: from 0.65 to 0.75 wt %,
Ni: from 0.15 to 0.25 wt %,
Cu: max 0.25 wt %,
Al: from 0.015 to 0.035 wt %,
Ti: from 0.031 to 0.038 wt %,
N: max 0.012 wt %,
V: max 0.05 wt %
B: from 0.001 to 0.0025 wt %,
Nb: from 0.02 to 0.03 wt %,
wherein the balance of said steel being iron and unavoidable impurities from industrial processing including elements P, S, and H, the amounts of which, expressed in weight %, relative to the total weight of said chemical composition are as follows:
P: ≤0.015%,
S≤0.003%, and
H≤0.003%, and
having a yield strength (Ys) of at least 862 MPa and an ultimate tensile strength (UTs), wherein a ratio between the yield strength (Ys) and the ultimate tensile strength (UTs) is lower than 0.93,
wherein its microstructure comprises at least 95% of martensite related to the entire microstructure,
wherein the seamless steel pipe has a wall thickness which ranges from 38 to 78 millimeter.

2. The steel according to claim 1, wherein the chemical composition consisting of in weight percent:
C: from 0.27 to 0.30 wt %,
Si: from 0.22 to 0.30 wt %,
Mn: from 0.80 to 0.85 wt %,
Cr: from 1.30 to 1.40 wt %,
Mo: from 0.65 to 0.70 wt %,
Ni: from 0.15 to 0.20 wt %,
Cu: from 0.10 to 0.20 wt %,
Al: from 0.017 to 0.030 wt %,
Ti: from 0.031 to 0.038 wt %,
N: from 0.001 to 0.010 wt %,
V: from 0.001 to 0.020 wt %,
B: from 0.0010 and 0.0018%,
Nb: from 0.020 to 0.025 wt %,
wherein the balance of said steel being iron and unavoidable impurities from the industrial processing.

3. The steel according to claim 1, wherein the ratio between the yield strength (Ys) and the ultimate tensile strength (UTs) is lower than 0.9.

4. The steel according to claim 1, wherein the yield strength (Ys) is of at least 900 MPa.

5. The steel according to claim 1, wherein the ultimate tensile strength (UTs) is at least 950 MPa.

6. The steel according to claim 1, wherein the steel has a toughness value according to ASTM E23—Type A on a full size sample (10×10 mm) in the transverse direction at −40° C. which is at least:

| Yield strength (kSi) | Charpy test energy (J) |
|---|---|
| 125-135 (included) | 100 |
| 135 (excluded)-155 | 80 |

7. The steel according to claim 1, wherein the steel has a toughness value according to ASTM E23—Type A on a full size sample (10×10 mm) in the transverse direction at −60° C. which is at least:

| Yield strength (kSi) | Charpy test energy (J) |
|---|---|
| 125-135 (included) | 80 |
| 135 (excluded)-155 | 64 |

8. The steel according to claim 1, wherein the composition satisfies the relation below between the nickel, chromium and manganese contents:

$$\Sigma(Ni,Cr,Mn) \geq 2.36 \text{ wt } \%$$

9. The steel according to claim 1, wherein the composition satisfies the relation below between the nickel, chromium and manganese and silicon silicium contents:

$$\Sigma(Ni,Cr,Mn,Si) \geq 2.62 \text{ wt } \%$$

10. The steel according to claim 1, wherein its microstructure comprises at least 99% of martensite related to the entire microstructure.

11. A method of production of steel seamless pipe according to claim 1 the method comprising:
(i) providing a steel having the chemical composition as defined according to claim 1,
(ii) hot forming the steel at a temperature ranging from 1100° C. to 1300° C. through a hot forming process to obtain a pipe, then
(iii) heating up said pipe to an austenitizing temperature (AT) above or equal to 890° C. and keeping said pipe at the austenitizing temperature (AT) during a time comprised between 5 and 30 minutes, followed by
cooling the pipe to a temperature of at most 100° C. in order to obtain a quenched pipe, and
heating up and holding said quenched pipe at a tempering temperature (TT) ranging from 580° C. to 720° C. and keeping said pipe at the tempering temperature (TT) during a tempering time, and then cooling said pipe to a temperature of at most 20° C., in order to obtain a quenched and tempered pipe,
(iv) measuring the yield strength to ultimate tensile strength ratio and controlling that said ratio is lower than 0.93.

12. An oil and gas accessory and/or mechanical component comprising at least a seamless pipe according to claim 1.

13. A method to manufacture an oil and gas accessory and/or a mechanical component, comprising employing the steel according to claim 1.

14. The seamless steel pipe according to claim 1, wherein the composition contains H: greater than 0% to 0.003%, expressed in weight %, relative to the total weight of said chemical composition.

15. A seamless steel pipe having the following chemical composition consisting of in weight percent:
C: from 0.27 to 0.30 wt %,
Si: from 0.20 to 0.35 wt %,
Mn: from 0.80 to 0.90 wt %,
Cr: from 1.30 to 1.45 wt %,
Mo: from 0.65 to 0.75 wt %,
Ni: from 0.15 to 0.25 wt %,
Cu: max 0.25 wt %, Al: from 0.015 to 0.035 wt %,
Ti: from 0.033 to 0.038 wt %,
N: max 0.012 wt %,
V: max 0.05 wt %
B: from 0.001 to 0.0025 wt %,
Nb: from 0.02 to 0.03 wt %,
wherein the balance of said steel being iron and unavoidable impurities from industrial processing including elements P, S, and H, the amounts of which, expressed in weight %, relative to the total weight of said chemical composition are as follows:
P: ≤0.015%,
S≤0.003%, and
H≤0.003%, and
having a yield strength (Ys) of at least 862 MPa and an ultimate tensile strength (UTs), wherein a ratio between the yield strength (Ys) and the ultimate tensile strength (UTs) is lower than 0.93,
wherein its microstructure comprises at least 95% of martensite related to the entire microstructure,
wherein the seamless steel pipe has a wall thickness which ranges from 38 to 78 millimeter.

* * * * *